US007572484B1

(12) United States Patent
Daley

(10) Patent No.: US 7,572,484 B1
(45) Date of Patent: Aug. 11, 2009

(54) METHODS FOR MAKING ABRASIVE ARTICLES HAVING DECORATIVE PATTERNS

(76) Inventor: Scott G. Daley, 1751 Baldwin Rd., Ojai, CA (US) 93023

( * ) Notice: Subject to any disclaimer, the term of this patent is extended or adjusted under 35 U.S.C. 154(b) by 388 days.

(21) Appl. No.: 10/946,492

(22) Filed: Sep. 21, 2004

Related U.S. Application Data

(62) Division of application No. 10/938,694, filed on Sep. 10, 2004, now abandoned.

(51) Int. Cl.
*B05D 1/38* (2006.01)
*A45D 29/00* (2006.01)

(52) U.S. Cl. ..... 427/258; 427/243

(58) Field of Classification Search ..... None
See application file for complete search history.

(56) References Cited

U.S. PATENT DOCUMENTS 4,459,779 A * 7/1984 Shen ..... 51/296
4,712,552 A 12/1987 Pangburn
4,933,306 A 6/1990 Pietsch
5,928,773 A 7/1999 Andersen
5,960,506 A 10/1999 Reuven
6,062,967 A 5/2000 Calafut et al.
6,145,512 A * 11/2000 Daley ..... 132/76.4
6,394,099 B1 5/2002 Daley
6,488,574 B1 12/2002 Calafut
6,494,213 B2 12/2002 Calafut
6,884,157 B2 * 4/2005 Chesley et al. ..... 451/538

* cited by examiner

*Primary Examiner*—William Phillip Fletcher, III
(74) *Attorney, Agent, or Firm*—William A. English; Vista IP Law Group LLP

(57) ABSTRACT

Methods are disclosed for making abrasive articles including decorative patterns. In one embodiment, the method includes printing inks or dyes onto an upper surface of a foam sheet to create a decorative pattern thereon, and bonding abrasive material over the decorative pattern, the abrasive material being translucent or transparent such that the decorative pattern is visible through the abrasive material. In another embodiment, the method includes providing a base layer, mixing abrasive material with binder material, one or more pigments, and a blowing agent, applying the first mixture to one or more regions of an upper surface of the base layer in a predetermined pattern, and curing the first abrasive mixture such that the blowing agent is activated to create an expanded abrasive layer on the upper surface of the base layer that has a thickness greater than adjacent regions of the upper surface.

5 Claims, 8 Drawing Sheets

METHODS FOR MAKING ABRASIVE ARTICLES HAVING DECORATIVE PATTERNS

This application is a divisional of application Ser. No. 10/938,694, filed Sep. 10, 2004 now abandoned.

FIELD OF INVENTION

The present invention relates generally to abrasive and/or foam articles, and, more particularly, to nail files, pumice stones, and other abrasive articles for personal grooming having a decorative and/or colored pattern on and/or underlying one or more surfaces of the article.

BACKGROUND

Many people groom their fingernails and toenails by filing and buffing them. The top surface of a nail is filed and polished using emery boards, nail files, and other similar tools, to produce a surface that shines or that can be decorated with a design and/or color.

A typical tool for filing nails includes a core or base sheet having at least one abrasive surface. The core is typically a flat, substantially rigid sheet, such as paper, wood, plastic, or foam having two sides. A layer of abrasive is attached to one or both sides to provide filing or buffing surfaces for the tool. Optionally, one or more layers of foam or other flexible material may be provided between the core sheet and the layer of abrasive. For two-sided tools, the same abrasive grit may be provided on both sides, or different grits may be provided on each side.

Many nail tools have a plain appearance, e.g., a simple gray or tan color of the sandpaper commonly applied to the surface (s) of the core sheet. To enhance the appearance of nail tools, it has been suggested to provide a decorative and/or colored pattern to the surface of the abrasive layer(s). For example, U.S. Pat. No. 6,145,512, which names the same inventor as the present application, discloses applying dyes to the surface (s) of nail tools using sublimation.

Alternatively, the '512 patent suggests providing a sheet of paper or fabric between the core and abrasive layer, the sheet including a colored and/or decorative pattern thereon. The '512 patent teaches using transparent materials over the sheet, e.g., for the abrasive layer and for any adhesives used, to allow the pattern to be visible through the abrasive layer.

Similarly, U.S. Pat. No. 6,488,574 to Calafut discloses placing a sheet including a pictorial image, such as a photograph or printed matter, beneath a transparent or translucent abrasive surface of a nail file. Alternatively, the '574 patent discloses printing on the back side of the abrasive layer. One problem with printing on the back side of the abrasive layer is that they generally include polyester or other films to which abrasive material is attached. Dyes or inks, particularly water-based dyes or inks, may not bond to such films. Consequently, printing on such films may result in the dyes bleeding or beading, thereby impairing the quality of any image that is applied to the films.

SUMMARY OF THE INVENTION

The present invention is directed generally to abrasive and/or foam articles, e.g., nail files, pumice stones and/or other abrasive articles for personal grooming, and more particularly to abrasive articles having a decorative and/or colored pattern on and/or underlying one or more outer surfaces of the article.

In accordance with one embodiment of the present invention, an abrasive article is provided, e.g., for personal grooming and/or other cleaning or buffing. Generally, the tool may include a base layer including an upper surface, and an abrasive layer on the upper surface of the base layer.

In one embodiment, the abrasive layer may include a first region including abrasive material and a blowing agent, and a second region including abrasive material such that the first region has a thickness greater than the second region, thereby creating a three-dimensional decorative pattern extending from the upper surface of the base layer. Optionally, the first region and/or the second region may include one or more pigments such that the decorative pattern includes a colored pattern.

The first region may cover only a portion of the upper surface of the base layer, and the second region may substantially cover a remainder of the upper surface of the base layer. Alternatively, the first region and/or second regions may at least partially overlap one another. In addition or alternatively, the abrasive layer may include a third or additional regions separate from and/or overlapping the first and/or second regions, and may include a blowing agent, pigment, glitter, pearlessence, and/or other decorative materials.

In another embodiment, the abrasive article may include a translucent or substantially transparent abrasive layer including a lower surface and an upper surface, the upper surface including translucent or substantially transparent abrasive material thereon. A layer of adhesive may be provided on the lower surface of the abrasive layer, e.g., to attach the abrasive layer to the upper surface of the base layer. A decorative pattern may be printed between the layer of adhesive and the base layer. For example, the decorative pattern may be printed on the lower surface of the abrasive layer such that the decorative pattern is visible through the abrasive layer. In addition or alternatively, the decorative pattern may be printed on the upper surface of the base layer.

In yet another embodiment, the abrasive article may include an abrasive layer on the upper surface of the base layer, the abrasive layer including a plastic sheet, a decorative pattern printed on the sheet, and abrasive material attached to the sheet over the decorative pattern. The abrasive material may be translucent or substantially transparent such that the decorative pattern is visible through the abrasive material.

Optionally, the abrasive layer may include a bonding enhancement layer on the upper surface of the sheet, the decorative pattern being printed on the bonding enhancement layer.

In accordance with another aspect of the present invention, a method is provided for manufacturing an abrasive article that includes a base layer including an upper surface. Abrasive material may be mixed with binder material, one or more pigments, and a blowing agent to provide a first abrasive mixture. The first abrasive mixture may be applied to one or more regions of the upper surface of the base layer in a predetermined pattern. The first abrasive mixture may be cured such that the blowing agent is activated to create an expanded abrasive layer on the upper surface of the base layer.

Optionally, abrasive material may be mixed with binder material, e.g., without a blowing agent, to provide a second abrasive mixture, and the second abrasive mixture may be applied to one or more regions of the upper surface of the base layer, e.g., separate from the first region. In addition or alternatively, one or more pigments may be mixed with first and/or second abrasive mixtures.

In accordance with yet another embodiment of the present invention, a method is provided for manufacturing an abrasive article having a decorative pattern using a plastic sheet having an upper surface. A bonding enhancement layer may be applied to the upper surface of the sheet, a decorative pattern may be printed onto the bonding enhancement layer, and abrasive material may be attached to the sheet over the decorative pattern to provide a desired abrasive grit. The abrasive material may be translucent or substantially transparent such that the decorative pattern is visible through the abrasive material.

Other aspects and features of the present invention will become apparent from consideration of the following description taken in conjunction with the accompanying drawings.

DETAILED DESCRIPTION OF THE PREFERRED EMBODIMENTS

Figure 1:
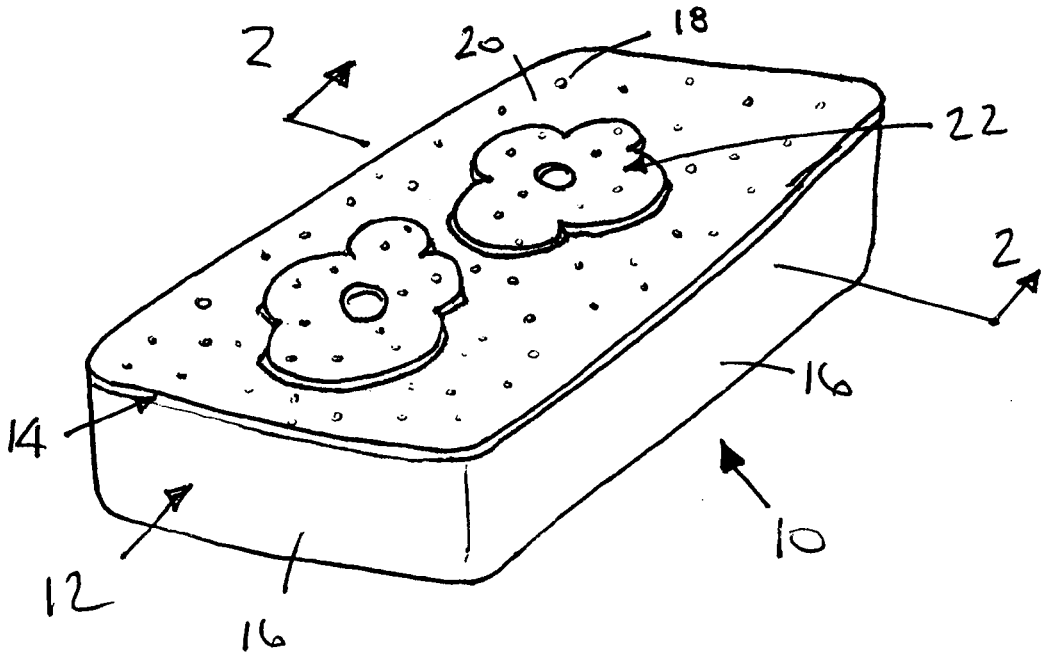
FIG. 1 is a perspective view of a first embodiment of a buffing tool having a decorative pattern thereon.
Figure 2:
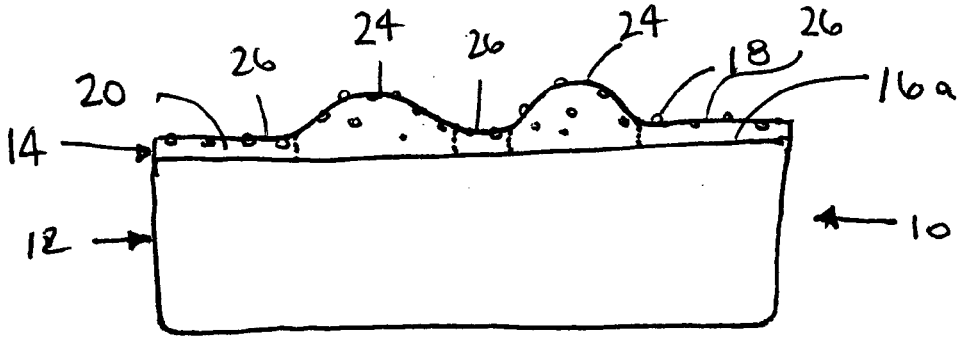
FIG. 2 is a cross-sectional view of the buffing tool of FIG. 1, taken along line 2-2.

Turning to the drawings, FIGS. 1 and 2 show an exemplary embodiment of an abrasive tool 10, in accordance with one aspect of the present invention. The tool 10 may be a handheld tool for personal grooming, e.g., a tool for filing and/or buffing fingernails or toenails, a pumice stone for removing calluses or excess skin, and the like. Alternatively, the tool 10, may be used for buffing and/or cleaning objects, such as furniture, dishes, and the like.

Generally, the tool 10 includes a base layer 12 including one or more surfaces 16, and an abrasive layer 14 on at least one of the surfaces 16. As shown in FIGS. 1 and 2, the abrasive layer 14 is only provided on an upper surface **16*a* of the base layer 12**. Alternatively, two or more surfaces of the base or core layer may include an abrasive layer.

Figure 3:
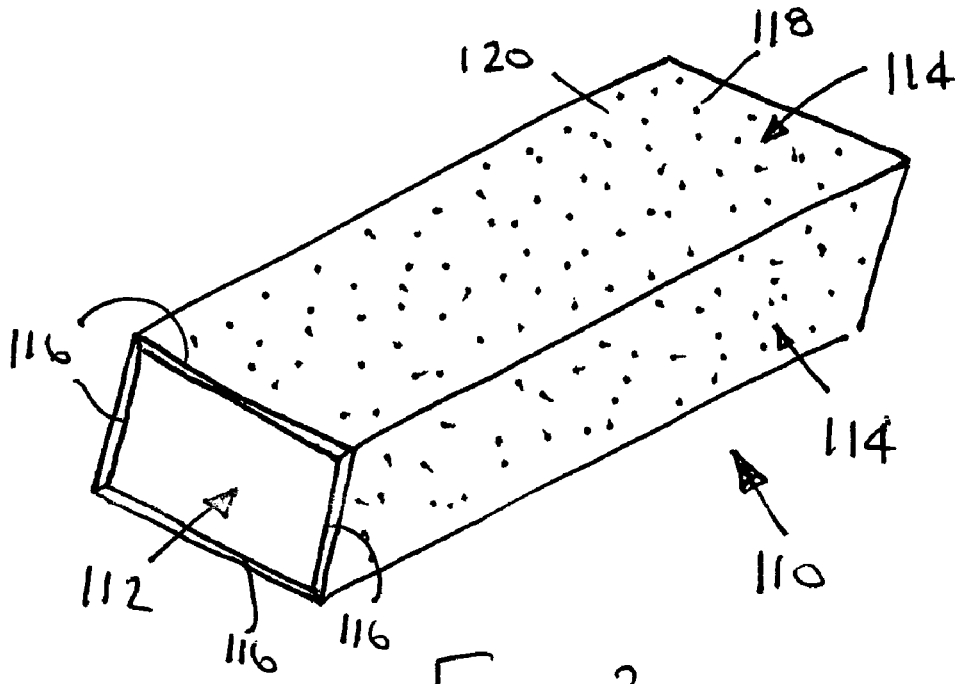
FIG. 3 is a perspective view of an embodiment of a multiple-sided nail tool.

For example, as shown in FIG. 3, a nail tool 110 may include a base or core layer having a square, rectangular, or other cross-section, and an abrasive layer 114 on two or more of the elongate surfaces 116 of the core (with four being shown). A decorative pattern (not shown) may be provided on each of the surfaces 116, similar to the other embodiments described herein. The abrasive grit of the abrasive layers 114 may be the same or may vary on each of the surfaces 116, e.g., to provide a single tool capable of coarse filing and fine buffing.

Returning to FIG. 1, the base layer 12 of tool 10 may include one or more layers of foam or other flexible material including an upper surface 16. As shown, the base layer 12 is a single piece of foam having a desired length, width, and thickness. In an exemplary embodiment of a personal grooming tool, the tool 10 may have a length between about two and ten inches (50-250 mm), a width between about a quarter inch and four inches (6-100 mm), and a thickness between about 1/32 inch and two inches (0.75-50 mm). Alternatively, the base layer 12 may include multiple heterogeneous layers bonded or otherwise attached together (not shown), e.g., including a substantially rigid or semi-rigid core and one or more layers of foam or other flexible or resilient material, similar to other embodiments described herein. Other nail tools including exemplary embodiments of base layers that may be used are described in U.S. Pat. Nos. 6,145,512 and 6,394,099, the entire disclosures of which are expressly incorporated by reference herein.

The upper surface 16 may be substantially flat or planar, as shown, or alternatively, may have a convex or other three-dimensional shape. Alternatively, the base layer 12 may have an organic or other three-dimensional shape, similar to the articles disclosed in co-pending application Ser. No. 10/901,488, filed Jul. 27, 2004, entitled "Pumice Stones and Methods for Making Them", the entire disclosure of which is expressly incorporated by reference herein.

Exemplary materials for the base layer 12 include open or closed cell foam (e.g., cross-linked polyethylene, polypropylene, polyolefin, polyurethane, and the like), cork, thermoplastic material, such as polyvinyl chloride (PVC), paper, fabric, and/or other material. The base layer 12 may be substantially rigid, semi-rigid, or flexible, depending upon the flexibility of the materials of the abrasive layer 14 of the tool 10. For example, if the material of the abrasive layer 14 is relatively brittle, more rigid material may be used for the base layer 12 to adequately support the abrasive layer 14, while more flexible materials may be used for the base layer 12 if the abrasive layer 14 is flexible and/or stretchable. Optionally, the base layer 12 may have a hollow core (not shown), which may reduce the overall weight and/or conserve materials of the tool 10.

Generally, the abrasive layer 14 includes abrasive material, represented by exemplary grains 18, and binder material 20 to fix the abrasive material 18 and/or bond the abrasive material 20 to the upper surface **16*a* of the base layer 12. In addition, one or more regions of the abrasive layer 14 may include one or more dyes, inks, or other pigment to provide a decorative and/or colored pattern 22**.

In the exemplary embodiment shown, the decorative pattern 22 includes a plurality of flowers arranged on the upper surface **16*a* to provide an aesthetically attractive appearance. Alternatively, the decorative pattern 22** may include other images or patterns, such as photographs, drawings, or paintings of people, animals, objects, food items, and/or places; icons or alphanumeric symbols; animated, fictional, and/or nonfictional characters; and the like (not shown).

The abrasive layer 14 may include a blend of abrasives, e.g., selected to provide desired properties for the finished product. For example, the abrasive material 18 may include one or more of aluminum oxide, acrylic or other plastic, glass, pumice, garnet, flint, silica or other sand, silicon carbide, quartz, and the like. The abrasive material 18 may be ground or otherwise provided in powder, grains, or other particles of a desired size and/or shape, e.g., having a size between about twenty and two hundred eighty (20-280) grit, or between about forty and one hundred fifty (40-150) grit. The abrasive material 18 may be mixed together in a predetermined ratio, e.g., into a single substantially uniform blend before being mixed with the binder material. Alternatively, multiple blends may be mixed and provided together and utilized for different portions of the tool 10, as explained further below.

In one embodiment, the abrasive material 18 may include a blend of substantially transparent or translucent material, e.g., aluminum oxide, glass, and/or acrylic abrasive. Transparent and/or translucent abrasive material may enhance the appearance of pigment or other color added or applied to the tool 10, as explained further below.

In an exemplary embodiment, the abrasive material 18 may include between about forty and sixty percent (40-60%) by weight each of aluminum oxide and acrylic abrasive. Aluminum oxide has a more coarse abrasive grit compared to acrylic, but also has greater density. Thus, to provide a more abrasive tool 10, the ratio of aluminum oxide to acrylic may be increased, which may increase the overall weight of the tool 10. Optionally, glass may also be included in the blend, e.g., to enhance further the abrasive grit of the tool 10 without adding substantially to the opacity of the abrasive material 18. However, if glass is added, it may be desirable to treat the glass grains, e.g., to reduce the jaggedness or sharpness of the grains to prevent cutting or reduce abrading to a desired grit.

The binder material 20 may include any material capable of fixing the abrasive material 18 together and/or to the upper surface 16*a* of the tool 10, while still providing an abrasive surface having a desired grit. For example, the binder material 20 may include one or more resins, e.g., acrylic, latex, natural or synthetic rubber, polyester, polyvinyl acetate ("PVA"), polyurethane, silicone, phenolic, alkyds, polyamide, epoxy, or other polymers or combinations that may be cured under desired conditions. The binder material 20 may be cured under substantially ambient temperatures and/or pressures, or using increased pressure and/or heat, e.g., to enhance, accelerate, and/or complete curing. Alternatively, the binder material 20 or any of the other adhesive or resins described herein may be curable simply by exposure to ultraviolet light.

Optionally, one or more regions of the abrasive layer 14 may include a puffing or blowing agent, such as azodicarbonamide. The blowing agent(s) may be mixed with the resin(s) of the binder material 20 in a predetermined ratio, e.g., along with the abrasive material 18 and/or any pigment(s). In an exemplary embodiment, only a relatively small amount of blowing agent is added to resin. For example, the ratio of blowing agent to resin may be less than about one percent by weight, between about one and fifty percent by weight, or between about five and ten percent, e.g., such that the blowing agent comprises not more than about one percent (1%) by weight of the binder material 20.

With reference again to FIGS. 1 and 2, in an exemplary embodiment, the regions of the abrasive layer 14 including the decorative pattern 22 (or a portion of the decorative pattern) may include a blowing agent, while the remainder of the abrasive layer 14 may not. When the binder material 20 is cured, the blowing agent may expand, thereby creating a three-dimensional decorative pattern extending from the upper surface 16*a* of the base layer 12.

As best seen in FIG. 2, the regions 24 may include a blowing agent such that the abrasive layer 14 in these regions 24 expands between about one hundred and one thousand percent, i.e., such that a thickness of the regions 24 is substantially greater than a thickness of the adjacent regions 26 that do not include a blowing agent. In exemplary embodiments, the regions 24 may expand to a final thickness between about 1/32 and 3/8 inch (0/75-10 mm), while the regions 26 may remain at a substantially unexpanded thickness.

To manufacture the tool 10, one or more materials may be provided for the base layer 12. For example, the base layer 12 may be a single piece of foam that may be cut from larger stock, extruded, molded, and the like. Alternatively, the base layer 12 may include multiple layers of material attached to one another, e.g., a plastic, paper, or other sheet or substrate, and one or more layers of foam on one or more sides of the substrate (not shown).

The materials for the abrasive layer 14 may be prepared, either beforehand or after providing the base layer 12. The components for the abrasive material 18 may be selected and mixed together to provide a substantially homogeneous abrasive grit. For example, aluminum oxide and acrylic grains, in a desired ratio, may be mixed together substantially dry to provide a desired blend of abrasive material. The resin for the binder material 20 may be selected and prepared using conventional methods.

Once the resin or other material for the binder material 20 is prepared, the abrasive material 18 may be mixed into the binder material 20. The ratio of abrasive material 18 to binder material 20 is generally sufficient to hold the abrasive material 18 together, yet allow the resulting mixture to flow and/or be applied to a surface. Generally, sufficient binder material is provided to coat the abrasive material 18, and not so much that the mixture is a slurry, as will be appreciated by those skilled in the art. For example, exemplary ratios of abrasive material to binder material may be between about 3:1 and 1:3 by weight, e.g., between about 5:2 and 5:3 excluding any solvents that may be included in the mixture.

Optionally, one or more pigments may be mixed with the binder material 20, e.g., before or after mixing in the abrasive material 18. Alternatively, pigment(s) may be mixed wet or dry with the abrasive material 18 before being mixed into the binder material 20. In addition or alternatively, one or more blowing agents may be added to the binder material 20 at any time during preparation and/or mixing. In further options, other materials may be added to the mixture, e.g., glitter, colored mineral powders, pearlessence, opalessence, and the like, to further enhance the aesthetic finish of the abrasive layer 14.

For example, with continued reference to FIGS. 1 and 2, abrasive material may be mixed with binder material, one or more pigments, and a blowing agent to provide a first abrasive mixture, e.g., for the first regions 24. Separately, abrasive material may be mixed with binder material and one or more pigments to provide a second abrasive mixture (without blowing agent), e.g., for the second regions 26. Once an appropriate number of abrasive mixtures are prepared (optionally, including a blowing agent and/or different pigments), the mixtures may be applied to the upper surface 16*a* to create the abrasive layer 14.

In one embodiment, the first abrasive mixture may be applied directly to the upper surface 16*a* of the base layer 12 in a predetermined pattern. For example, the first abrasive mixture may be applied to the regions 24 (shown in FIG. 2), which correspond to the flower arrangement shown in FIG. 1. The second abrasive mixture may be applied to the remaining regions 26 of the upper surface 16*a*, e.g., to cover substantially all or only a portion of the upper surface 16*a* with the abrasive mixtures.

Alternatively, the second abrasive mixture may be applied over the entire upper surface 16*a* and the first abrasive mixture may be applied only to the regions 24, such that the abrasive mixtures overlap one another. This alternative may facilitate manufacturing, e.g., allowing the second abrasive mixture to be applied broadly, with the first abrasive mixture being applied more precisely thereafter.

Optionally, one or more other abrasive mixtures (not shown) may be applied to different regions of the upper surface 16*a*, e.g., to provide additional colors and/or include varying amounts of blowing agent. It may be desirable to have each of the abrasive mixtures on the upper surface 16*a* of the base layer 12 have the same abrasive grit, such that a homogenous abrasive finish is provided. Alternatively, it may be desirable to provide a higher abrasive grit in one or more regions to facilitate filing or buffing using different regions of the same surface.

The abrasive mixtures applied to the upper surface 16*a* may then be cured, e.g., to activate the blowing agent, melt or otherwise activate any pigment(s), and/or to cure the resin(s) of the binder material 20. The binder material 20 may cure under substantially ambient conditions, or may be cured by heating. To activate the blowing agent, the abrasive mixtures may need to be heated, e.g., to a temperature between about two hundred fifty (250) and five hundred (500) degrees Fahrenheit (121-260° C.). The temperatures for curing may be limited, e.g., by the materials of the tool 10, such as the foam or other material(s) of the base layer 12. As the regions 24 including the blowing agent are heated, the blowing agent may expand, thereby causing the regions 24 to expand from the upper surface 16*a* of the base layer 12.

Figure 4:
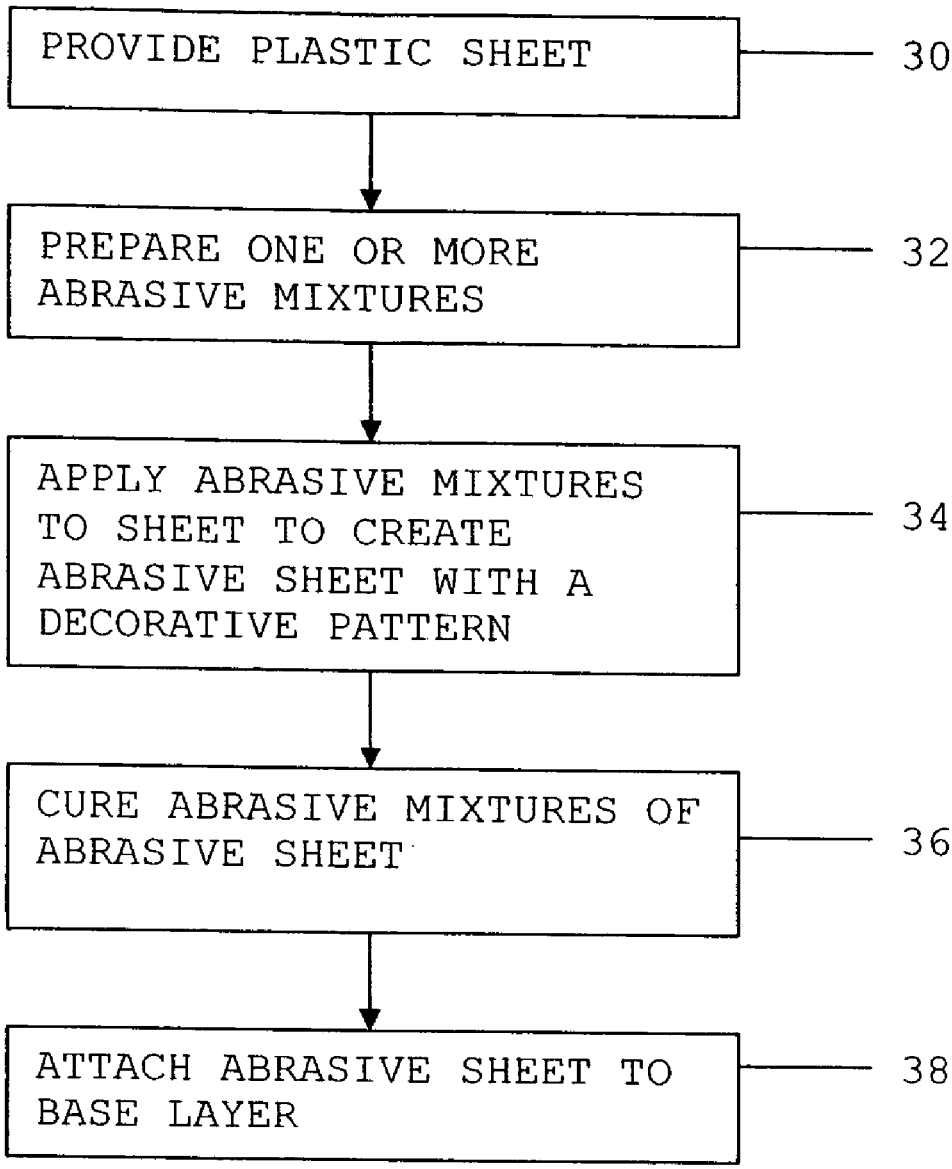
FIG. 4 is a flow chart showing a method for making an abrasive tool.

Turning to FIG. 4, in an alternative method, the abrasive mixtures may be applied to a separate surface, instead of directly to the base layer 12. For example, at step 30, a thin film or other sheet (not shown) may be provided. The sheet may be a polyester, vinyl, styrene, PET, PETE, PETG, nylon, or other plastic film, or other material, e.g., having a thickness of between about 0.002-0.025 inch (0.05-0.625 mm).

At step 32, one or more abrasive mixtures are prepared, similar to the embodiments described above. In an exemplary embodiment, at least one of the abrasive mixtures includes a blowing agent, while at least one of the abrasive mixtures does not. One or more of the abrasive mixtures may include pigment or other components to enhance the aesthetic appearance of the final tool.

At step 34, the abrasive mixture(s) may be applied to the sheet. For example, a plurality of abrasive mixtures may be applied successively to different regions of the sheet to create a decorative pattern on the sheet. In an exemplary embodiment, the entire sheet is covered by the abrasive mixture(s).

At step 36, the abrasive mixtures applied to the sheet may be cured. For example, the entire abrasive sheet may be heated to a desired temperature for a predetermined time to activate the blowing agent and/or cure the resin, similar to the previous embodiments. Optionally, pressure may be applied to the abrasive sheet, e.g., a platen or roller, before or while curing the abrasive mixtures. Such pressure may ensure that the abrasive mixtures are distributed at a substantially uniform thickness on the sheet, e.g., as measured before the blowing agent is activated.

At step 38, once the abrasive mixtures are cured, the abrasive sheet may be bonded or otherwise attached to a base or core layer. For example, an adhesive may be applied to one or both of the upper surface of the base layer and the bottom of the abrasive sheet. The adhesive may be a liquid that is sprayed, brushed, or otherwise applied, or may be a tacky layer, e.g., applied from a transfer sheet. The abrasive sheet may then be applied to the upper surface of the base layer. The adhesive may then be cured, if necessary. For example, the adhesive may be pressure-activated, e.g., by applying a roller over the abrasive sheet. In addition or alternatively, the adhesive may be cured by heating the tool 10 to a predetermined temperature.

Returning to FIG. 1, the base layer 12 may be cut, molded, extruded, or otherwise provided in a size intended to make a single tool 10. The abrasive layer 14 may be applied directly to the upper surface 16*a* as described previously, or a pre-manufactured abrasive sheet may be cut or otherwise formed into a shape intended to fit the upper surface 16*a* (and/or other surfaces of the base layer 12), e.g., using the method just described.

Alternatively, instead of making an individual tool 10, a plurality of tools may be manufactured simultaneously, and then separated to provide individual tools. For example, a large sheet may be provided having a thickness corresponding to the thickness of the base layers of the individual tools that are being manufactured. The large sheet may be cut from larger sheets or rolls, may be molded, extruded, and the like, and/or may be laminated from multiple materials having a size and shape corresponding to a plurality of tools. Optionally, the large sheet may be scored, perforated, or otherwise treated to facilitate its separation into individual tools.

Abrasive mixtures may be applied directly to an upper surface of the large sheet, e.g., to provide a plurality of similar or different decorative patterns on the upper surface of the large sheet. Alternatively, a large abrasive sheet having one or more decorative patterns thereon may be made using procedures similar to those described above, and bonded or otherwise attached to the large sheet. Optionally, abrasive mixtures or an abrasive sheet may also be applied to a lower surface of the large sheet. The resulting assembly may then be cut or otherwise separated into individual tools. Each resulting tool may have a similar size, shape, and/or decorative pattern, e.g., such as the tool 10 shown in FIG. 1, or the individual tools may have different sizes, shapes, and/or decorative patterns.

Figure 11:
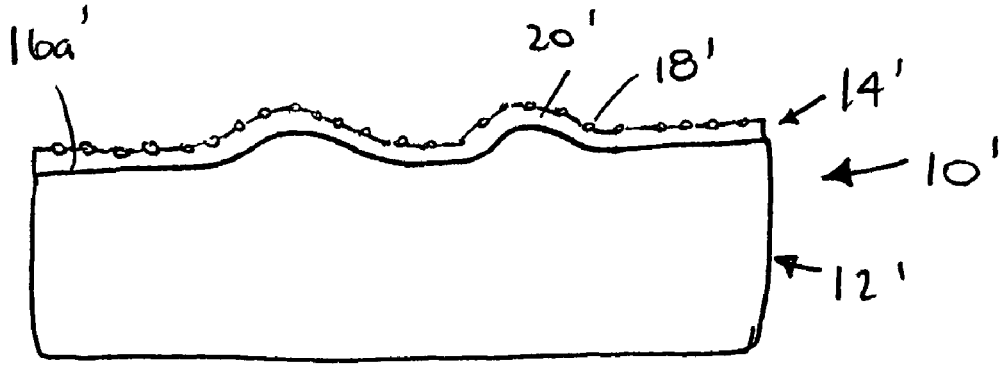
FIG. 11 is a cross-sectional view of another embodiment of an abrasive tool including a three dimensional abrasive surface.

Turning to FIG. 11, an alternative embodiment of an abrasive tool 10' is shown that includes a three-dimensional abrasive surface, similar to the embodiment shown in FIGS. 1 and 2. The tool 10' includes a base layer 12' and an abrasive layer 14' attached to one or more surfaces of the base layer 12' (shown attached to surface 16*a*'). Unlike the previous embodiment, a blowing agent may be added to a base layer 12' to provide a raised upper surface 16*a*' for receiving an abrasive layer 14.' For example, if the base layer 12' includes a foam layer, a blowing agent may be mixed with a resin or adhesive, which may be applied to a sheet or other core (not shown). The resulting subassembly may then be heated to cause the blowing agent/resin/adhesive mixture to expand and create the foam layer.

An abrasive layer 14' may then be applied over the raised surface 16*a*,' similar to the other embodiments described herein, e.g., by applying a finished layer of abrasive or by applying a base coat, abrasive material, and sizing coat onto the raised surface 16*a*.' The abrasive layer 14' may have a substantially uniform thickness, as shown in FIG. 11. Alternatively, the abrasive layer 14' may include one or more regions with a blowing agent therein to enhance the three-dimensional effect of the finished tool 10.' Optionally, the abrasive layer 14' may include color, a decorative pattern, or other decorative components therein (not shown), similar to the other embodiments described herein.

Figure 12:
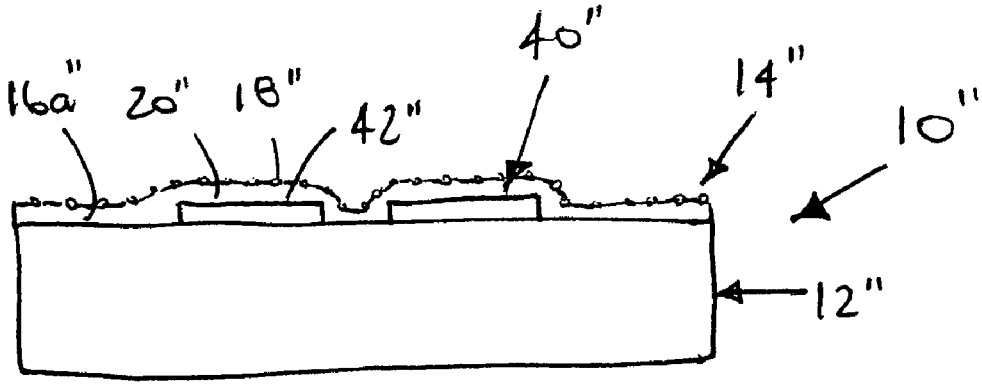
FIG. 12 is a cross-sectional view of yet another embodiment of an abrasive tool including a three dimensional object embedded therein.

Turning to FIG. 12, yet another embodiment of an abrasive tool 10" is shown that includes one or more three-dimensional objects 40" embedded therein. As shown, the object 40" may be embedded between a base layer 12" and an abrasive layer 14," which may be similar to any of the embodiments described elsewhere herein. The object 40" may include any decorative or colored object having a desired size and shape that may be attached to the upper surface 16*a*" of the base layer 12," e.g., one or more flowers and/or other objects, such as those described above that may be included in a decorative pattern. The object 40" may be formed from plastic, paper, fabric, and the like, that are not adversely impacted by any processing, e.g., heating and/or pressure, that may be used to manufacture the tool 10." Thus, the resulting tool 10" may have a three dimensional abrasive surface, similar to the embodiments described above. Optionally, the abrasive layer 14" and/or base layer 12" may include a blowing agent, if desired, to enhance the three-dimensional effect of the tool 10."

To make the tool 10," the base layer 12" may be provided, similar to the previous embodiments, and one or more objects 40" may be attached to or placed on the upper surface 16*a*" of the base layer 12." For example, the object(s) 40" may be bonded using an adhesive, may be at least partially melted to fuse with the base layer 12," and the like. A sheet of abrasive may be attached to the base layer 12" over the object(s) 40," e.g., using any of the methods described elsewhere herein. If the object(s) 40" is not attached to the base layer 12" the object(s) 40" may be secured between the abrasive layer 14" and the base layer 12" when the abrasive layer 14" is attached to the upper surface 16*a*."

In addition or alternatively, the object 40" may include a colored and/or decorative pattern (not shown) on an upper surface 42" or within the object 40." In this case, the components of the abrasive layer 14" may be translucent or substantially transparent, similar to other embodiments described herein, to allow the object 40" to be visible therethrough.

In another alternative, the object 40" may have a relative thin, i.e., inconsequential thickness, if it is not desired to create a three-dimensional effect. For example, the object 40" may be a thin sheet of paper or plastic with a colored and/or decorative pattern thereon. In yet another alternative, if the object 40" has a substantial thickness, after the object 40" is attached or placed on the upper surface 16*a*" of the base layer 12," resin or other material may be applied around the object 40" to be provide a substantially uniform, i.e., two-dimensional surface (not shown), for receiving the abrasive layer 14." The resin may include color and/or other decorative components, similar to other embodiments described herein, which may enhance the appearance of the object 40" and/or the final appearance of the tool 10."

Figure 5:
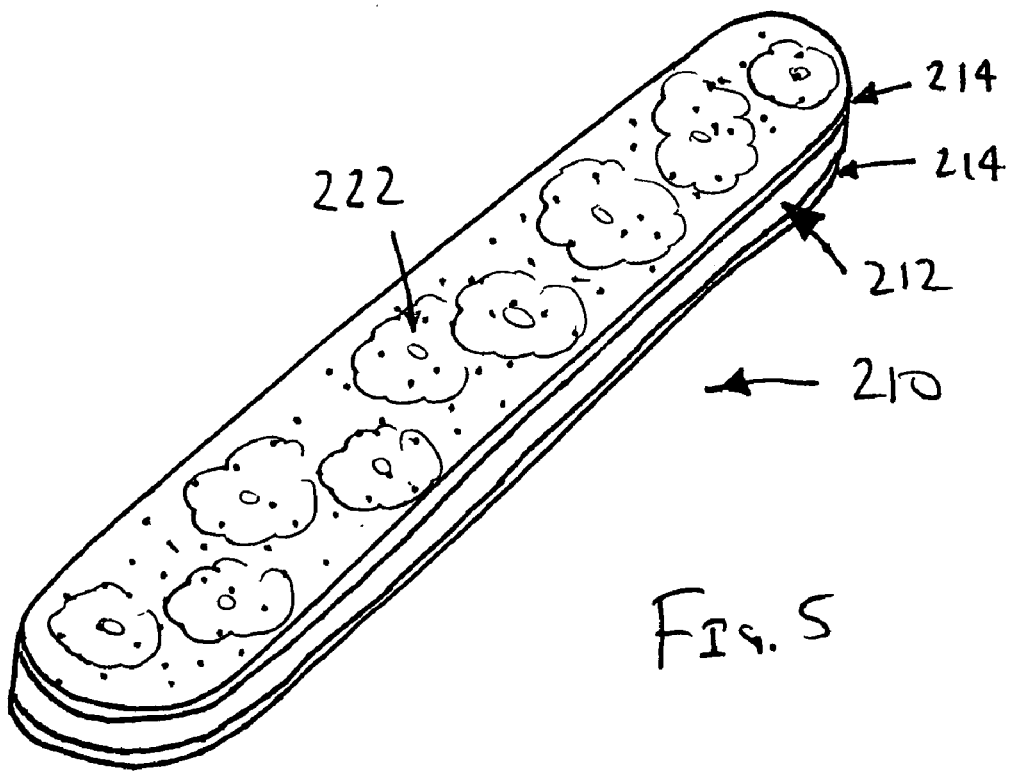
FIG. 5 is a perspective view of another embodiment of a nail tool including a base layer, and an abrasive layer having a decorative pattern therein.
Figure 6:
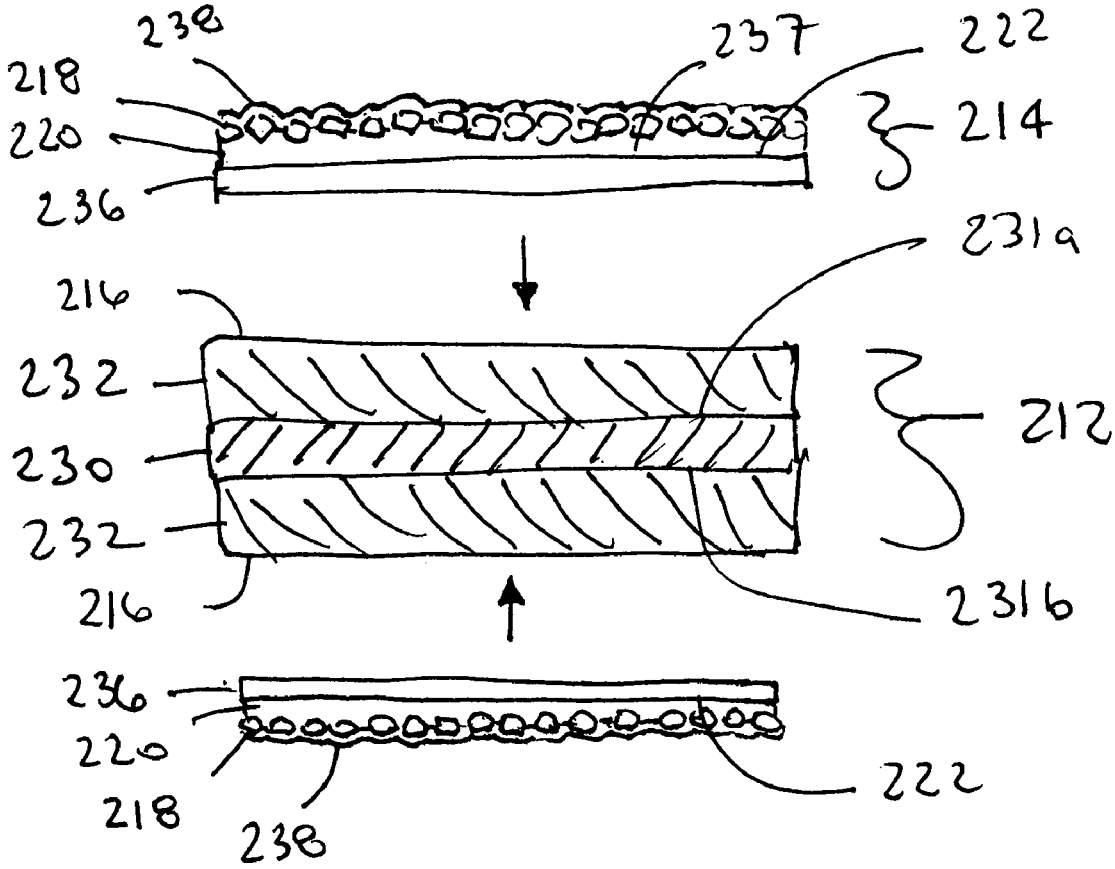
FIG. 6 is an exploded cross-sectional view of the nail file of FIG. 5, taken along line 6-6, showing the abrasive layer separate from the base layer.

Turning to FIGS. 5 and 6, another embodiment of a nail tool 210 is shown that includes a base layer 212, an abrasive layer 214 on each surface 216 of the base layer, and a decorative pattern 222 within the abrasive layer 214. The base layer 212 generally includes a substantially rigid substrate 230, e.g., a sheet of material that provides substantial support and flexibility, such as paper, wood, or plastic. For example, the substrate 230 may be an opaque plastic, such as white polyester or polystyrene, a substantially transparent plastic, such as styrene, acrylic, or polycarbonate, a cardboard sheet, and the like. The substrate 230 may have a thickness, e.g., ranging from about 0.1 mm to about 15 mm.

Optionally, the base layer 212 may include one or more layers of resilient material on one, two, or more surfaces of the substrate 230. As best seen in FIG. 6, the substrate 230 may have resilient material 232 on each of its upper and lower surfaces 231*a*, 231*b*. The resilient material 232 may be any cushioning material that allows the tool 210 to contour at least partially to the curvature of the anatomy or object being filed or buffed, such as a nail, but tends thereafter to return to its natural (e.g., planar) shape.

In addition, the resilient material 232 should be compatible with adhesives and may be heat and/or pressure resistant, similar to the substrate 230. Suitable materials for the resilient material 232 may include foam or rubber, which may be available in sheets, or may be applied to the substrate 230 in a liquid or other flowable form and cured. The resilient material 232 may have a thickness, e.g., between about one and ten millimeters (1-10 mm). Additional materials and methods that may be used for manufacturing base layers are disclosed in U.S. Pat. No. 6,145,512, incorporated by reference above.

With particular reference to FIG. 6, the abrasive layer 214 generally includes a film or other sheet 236, a decorative pattern 222 printed on the sheet 236, and a base coat 220 that acts as a binder for abrasive material 218. The sheet 236 may be plastic, e.g., polyester or other polymer, paper, fabric, and the like, which may be opaque, translucent, or substantially transparent, and/or may include a color therein.

The base coat 220 may include resins that are translucent or substantially transparent such that the underlying decorative pattern 222 is visible through the base coat 220. Similarly, the abrasive material 218 may be translucent or substantially transparent such that the abrasive material 218 does not substantially obstruct the underlying decorative pattern 222.

The base coat 220 may have a thickness of between about one hundred micrometers and fifteen millimeters (0.1-15 mm). Exemplary materials for the base coat 220 may include any of the materials described above for the binder material 20, such as epoxy, polyvinyl chloride acetate, acrylic, acrylic acetate, polyvinyl acetate, and the like. Optionally, the base coat 220 may include multiple layers of resin (not shown), e.g., to provide a desired effect for the finished tool 210. For example, different materials may be added to each layer, e.g., pigment, glitter, pearlessence, opalessence, colored mineral powders, and the like, to provide a three-dimensional effect to the finished tool 210.

The abrasive material 218 may be inserted or embedded into the base coat 220 using known procedures. For example, the abrasive material 218 may be applied to an uncured resin of the base coat 220 applied to the sheet 236 and forced into the surface, e.g., using a roller, platen, or other device that can apply pressure. Alternatively, the abrasive material 218 may be mixed with a resin and applied together to the sheet 236, similar to the previous embodiments. The abrasive material 218 may include any known grit materials having desired abrasive characteristics, such as those described above.

Optionally, the abrasive layer 214 may include a sizing coat 238 applied over the abrasive material 218 and/or base coat 220, e.g., by spraying or brushing. The sizing coat 238 may be a thin layer of substantially the same material as the base coat 220. The sizing coat 238 may be thick enough to support the abrasive material 218 attached to the base coat 220, but thin enough not to diminish substantially the desired abrasiveness of the abrasive material 218. For example, the sizing coat 238 may have a thickness between about five and ten millimeters (5-10 mm), or even less than about five millimeters (5 mm).

To print the decorative pattern 222 onto the upper surface 237 of the sheet 236, any known method for printing may be used, such as silk screening, spraying, brushing, sublimation, and the like. The decorative pattern 222 may be created by successively applying one or more inks, dyes, or other pigment, or by simultaneously applying multiple pigments. In an exemplary embodiment, multiple colors, such as conventional four-color printing, may be applied to the upper surface 237 of the sheet 236 using inkjet printing. The inks used may be water-based, which may reduce the risk of the printing clogging and/or may be more environmentally friendly than solvent-based inks.

To enhance application of the decorative pattern 222 to the sheet 236, it may be desirable to apply a bonding enhancement layer (not shown) to the upper surface 237 of the sheet 236 before the decorative pattern 222 is printed thereon. The bonding enhancement layer may be a relatively thin coating applied to the sheet, e.g., including solid particles carried by a binder material (also not shown). The solid particles may be fine powder that may be provided in sufficient concentration to provide a base to which inks or dyes may substantially bond. The binder material may carry a substantially uniform distribution of solid particles and may bond substantially to the sheet 236, thereby attaching the solid particles to the upper surface 237 of the sheet 236.

For example, a polyester or other plastic film may be commonly used for abrasive layers of nail files and other tools. Inks and dyes, particularly water-based inks, may not bond effectively to such films. If such water-based inks are applied directly to a polyester film, for example, the inks may bead, bleed, smear, or otherwise result in a poor quality decorative pattern. The bonding enhancement layer may provide a base, i.e., the solid particles, to which the inks may effectively bond immediately upon printing, thereby enhancing the resolution of the decorative pattern 222. In addition, the bonding enhancement layer may facilitate printing multiple colors simultaneously onto the sheet 236. In one embodiment, the bonding enhancement layer may be a coating of fumed silica. Alternatively, it may be sufficient to apply a thin coating of acrylic or other resin or adhesive to the sheet 236.

Figure 7:
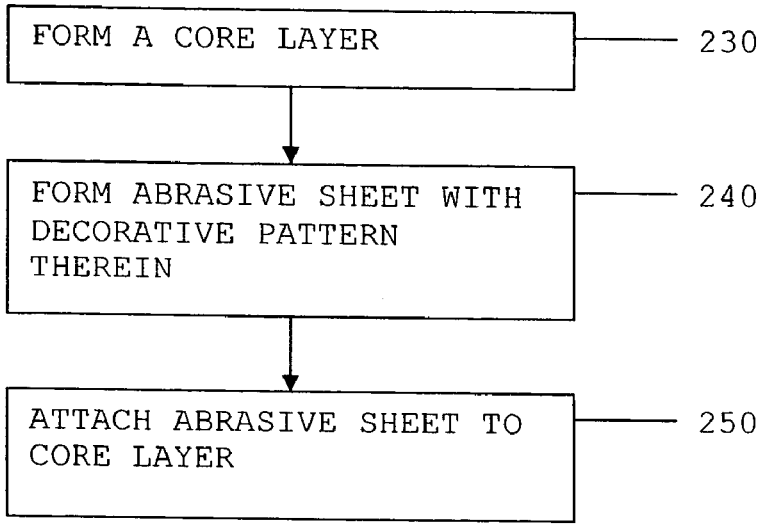
FIG. 7 is a flow chart showing another method for manufacturing an abrasive tool having a decorative pattern.

Turning to FIG. 7, to manufacture the tool 210, the following method may be used. Although the steps are described in an exemplary order, it will be appreciated that the steps may be completed in one or more different orders. Optionally, the method may also be used for manufacturing abrasive sheets, which may then be incorporated into other products besides tools for personal grooming, e.g., sanding devices, cleaning products, and the like.

Generally, the method includes three steps, namely forming a sheet for the core layer, forming a sheet for the layer of abrasive material that includes the decorative pattern therein, and bonding the core layer and the layer of abrasive material. In step 230, the core layer is generally formed by providing a substrate, and one or more sheets or coats of resilient material. A side of the substrate is coated with an adhesive, e.g., a liquid glue or a transfer film, such as adhesive film made by 3M. The adhesive may be pressure sensitive, curing when subjected to heat and/or pressure. Epoxy, PVC acetate, acrylic, and polyurethane are exemplary adhesives that may be used, e.g., since they may not be overly sensitive to heat.

A sheet or coating of resilient material may be applied to the surface with adhesive, adhering the resilient material to the substrate. If an additional layer of resilient material is desired, either on top of the first layer or on the other side of the substrate, the procedure may be repeated, first coating the desired surface with an adhesive and then adding another sheet or coat of resilient material. Finally, the exposed side(s) that may receive an abrasive sheet may be is coated with glue or other adhesive and provided with an opportunity to set.

Figure 8:
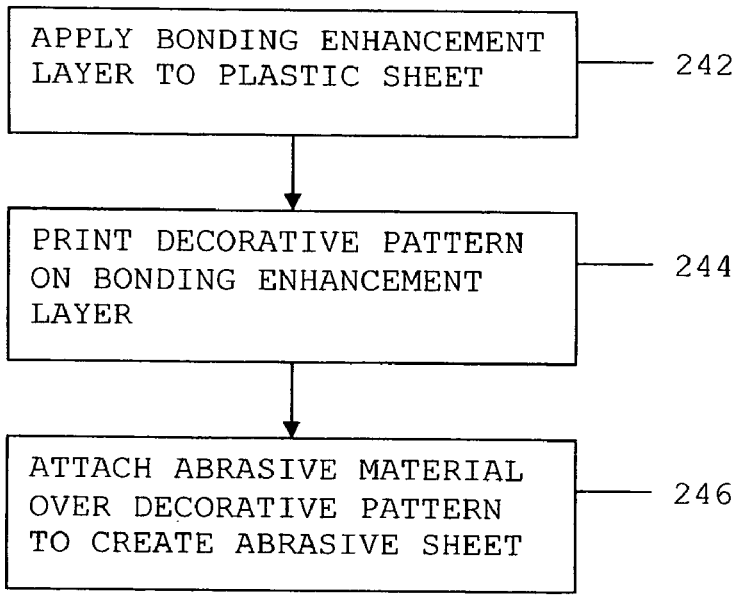
FIG. 8 is a flow chart showing a method for manufacturing an abrasive sheet having a decorative pattern therein.

At step 240, an abrasive sheet may be formed that includes a decorative pattern therein. For example, turning to FIG. 8, at step 242, a bonding enhancement layer may be coated or otherwise applied to an upper surface of a plastic sheet. In an exemplary embodiment, the sheet may be a polyester film, such as those commonly used for making abrasive sheets. To make the bonding enhancement layer, solid particles may be mixed with a resin or other binder material, and the resulting mixture may be sprayed, brushed, or otherwise applied to the upper surface of the sheet and the like. The resulting bonding enhancement layer is preferably substantially uniform in thickness and density to provide an even surface for inks or other pigment. The bonding enhancement layer may be cured or dried under substantially ambient conditions or using heat and/or pressure, similar to other curing methods described herein.

At step 244, a decorative pattern may be printed onto the bonding enhancement layer. In an exemplary embodiment, the printing process may include simultaneously four color printing, e.g., by inkjet, similar to the printing methods described elsewhere herein.

At step 246, abrasive material may be attached over the decorative pattern to provide a desired abrasive grit. For example, a base coat may be applied over the decorative pattern, and abrasive material may be attached to and/or embedded within the base coat. To attach the abrasive material, an electrostatic process may be used in which the base coat and the grains of the abrasive material are electrostatically charged such that the grains are attracted to the base coat and attach thereto.

Alternatively, the abrasive material may be mixed with resin, and the mixture may be applied over the decorative pattern. Optionally, a sizing coat may be applied over the abrasive material and/or base coat. The materials for the abrasive material, base coat, and/or sizing coat may be translucent or substantially transparent such that the decorative pattern is visible through the resulting abrasive layer. The particular methods and parameters involved in making the layer of abrasive materials over the decorative pattern are well known to those of ordinary skill in the art of making abrasive sheet materials, such as sandpaper.

Returning to FIG. 7, at step 250, the resulting abrasive sheet may be laminated to one or more sides of the core layer, creating a tool sheet. For example, the exposed surface(s) of the core layer and/or the lower surface of the plastic sheet of the abrasive sheet may be coated with glue or other adhesive. The abrasive sheet may then be applied to the exposed surface (s) of the core layer, and, if appropriate, the adhesive may be cured, e.g., using pressure and/or heat, to securely bond or otherwise attach the abrasive sheet to the core layer.

The resulting assembly may be an individual tool. Alternatively, the assembly may include a plurality of tools, which may be separated, e.g., using similar procedures to those described elsewhere herein. The finished tool(s) may have a decorative pattern applied within the abrasive sheet, yet visible to the user. Thus, the tool may have an aesthetically pleasing finish that may be appealing to buyers. Optionally, the decorative pattern and/or color of the materials of the tool may be selected to complement the user's décor, e.g., of their bathroom, kitchen, and the like.

Figure 9:
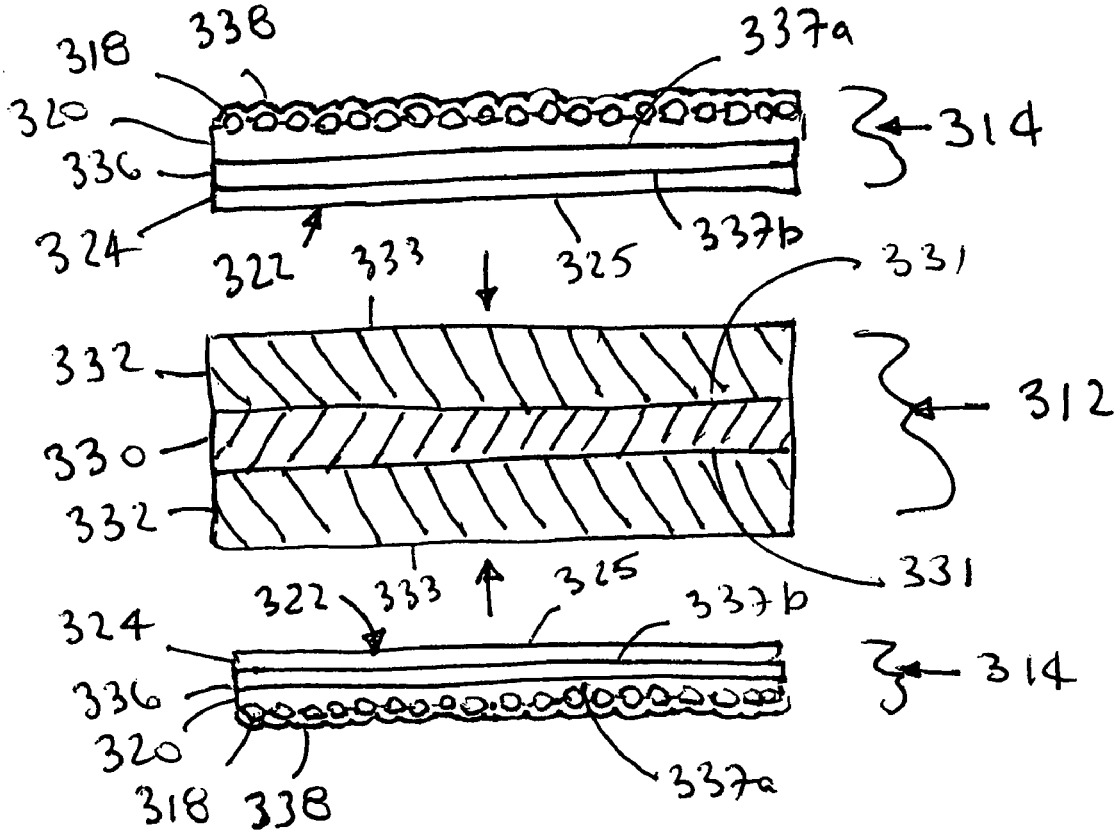
FIG. 9 is an exploded cross-sectional view of another embodiment of an abrasive tool having a decorative pattern.

Turning to FIG. 9, yet another embodiment of an abrasive tool 310 is shown that includes a base layer 312, an abrasive layer 314, one or more adhesive layers (one adhesive layer 324 shown) bonding the abrasive layer 314 to a surface 316 of the base layer 312, and a decorative pattern 322 printed between the adhesive layer 324 and the base layer 312.

Similar to the previous embodiments, the base layer 312 generally includes a substrate 330, e.g., a sheet of material that provides substantial support and flexibility, such as paper, wood, foam, and/or plastic. Optionally, the base layer 312 may also include one or more layers of resilient material 332 on one or more surfaces of the substrate 330, e.g., on the upper and lower surfaces 331, as shown.

The abrasive layer 314 generally includes a film or other sheet 336, and a base coat 320 that acts as a binder for abrasive material 318, similar to the previous embodiments. Optionally, the abrasive layer 314 may include a sizing coat 338 applied over the abrasive material 318 and/or base coat 320. The sheet 336, base coat 320, sizing coat 338, and/or abrasive material 318 may be translucent or substantially transparent such that the underlying decorative pattern 322 is visible through the abrasive layer 314. Optionally, the base coat 320 and/or sizing coat 338 may include pigment or other materials to enhance the aesthetic appearance of the tool 310. In addition or alternatively, the abrasive material 318 may include a color, e.g., the natural color of the abrasive material 318 or added pigment.

The adhesive layer 324 may include a glue, resin, transfer layer, or other adhesive that may be attached to the bottom of the abrasive layer 314. The decorative pattern 322 may include one or more inks, dyes, or other pigment printed onto at least one of the base layer 312 and/or the adhesive layer 324.

Figure 10:
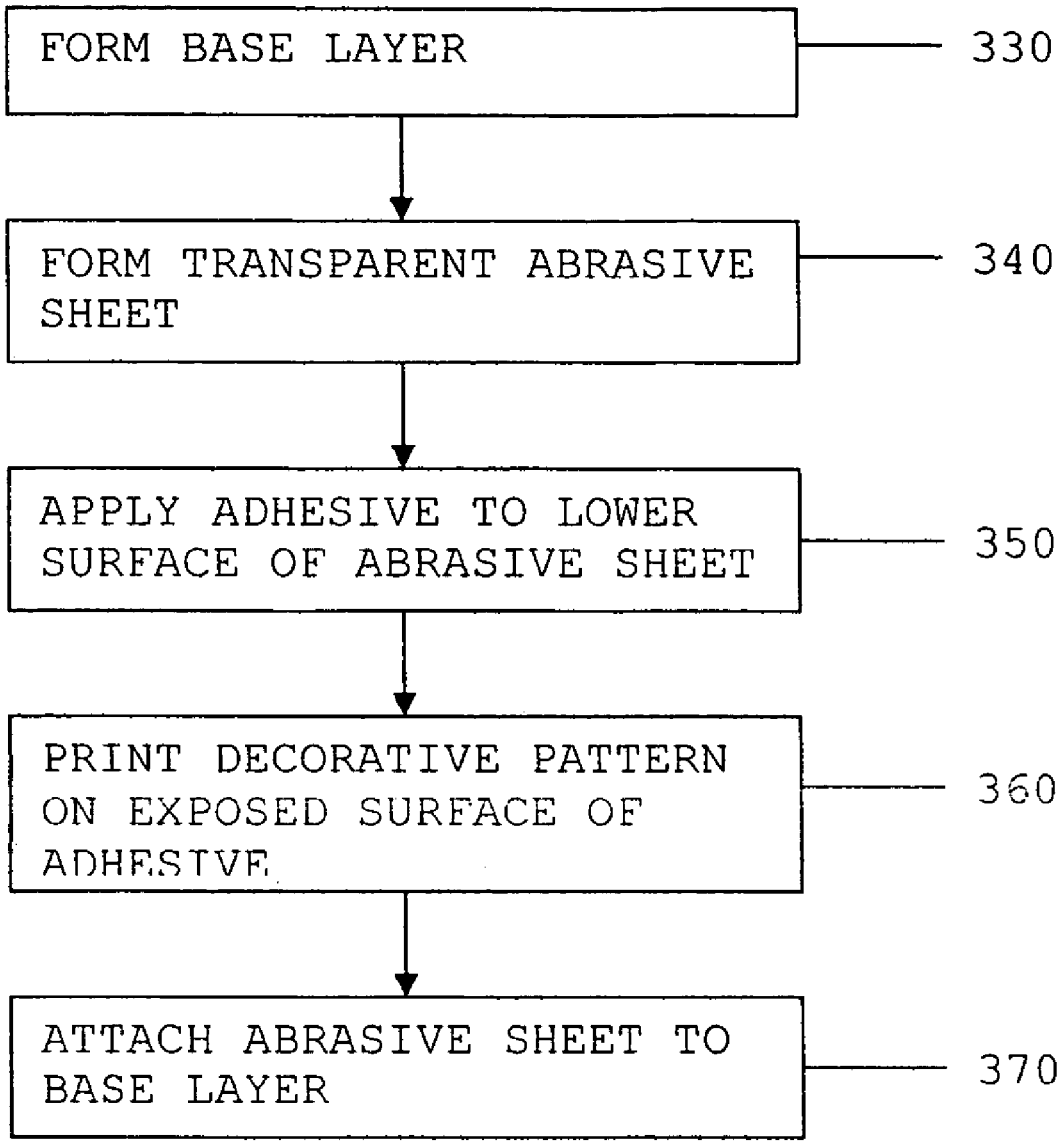
FIG. 10 is a flow chart showing a method for manufacturing the abrasive tool of FIG. 9.

Turning to FIG. 10 (with continued reference to the components shown in FIG. 9), a method for manufacturing the tool 310 is shown that generally includes five steps, namely forming a sheet for the base layer 312, forming a sheet for the abrasive layer 314, applying an adhesive to the bottom of the abrasive layer 314, printing a decorative pattern 322 on one or both of the adhesive layer 314 and the base layer 312, and attaching the base layer 312 and the abrasive layer 314.

In step 330, the base layer 312 is generally formed by providing a substrate 330, and, optionally, one or more layers of resilient material 332, similar to the previous embodiments. For example, an adhesive (not shown) may be applied to one side of the substrate 330, and a layer of resilient material 332 may be applied to the surface with the adhesive, attaching the resilient material 332 to the substrate 330. If an additional layer of resilient material is desired (not shown), either on top of the first layer or on the other side of the substrate 330, the procedure may be repeated.

At step 340, an abrasive sheet may be formed for abrasive layer 314. For example, a sheet 336 may be provided, and a base coat 320 and abrasive material 318 may be bonded to an upper surface 337*a* of the sheet 336. Optionally, a sizing coat 338 may be applied over the base coat 320 and/or abrasive material 318, similar to the previous embodiments.

At step 350, an adhesive 324 may be applied to the abrasive layer 314, e.g., to a lower surface 337*b* of the sheet 336. For example, a pressure sensitive adhesive may be sprayed, brushed, transferred from a transfer sheet, or otherwise applied to the lower surface 337*b*. The adhesive 324 may be translucent or substantially transparent, similar to the materials of the abrasive layer 314, to allow the decorative pattern 322 to be visible through the adhesive layer 324.

At step 360, a decorative pattern 322 may be printed onto an exposed surface 325 of the adhesive layer 324. For example, an inkjet printer (not shown) may be used to spray one or more inks onto the exposed surface 325. The printing process may include simultaneously four color printing or successively printing two or more different inks to different regions of the adhesive layer 324. The printer head (also not shown) of the inkjet printer or other printing device should be maintained a predetermined distance from the exposed surface 325 as the decorative pattern 322 is applied, e.g., between about half and three millimeters (0.5-3 mm). This may reduce the risk of the printer head becoming stuck in the adhesive layer 324, or of adhesive getting in the printer head, which may clog the printer head, while allowing the inks to be applied uniformly and/or with desired resolution and accuracy to the exposed surface 325.

Alternatively, the decorative pattern 322 may be printed on the exposed surface of the base layer 312. For example, a white base coat may be applied to the exposed surface 333 of the resilient layer 332, e.g., by spraying, brushing, silk screening, and the like. The decorative pattern 332 may then be printed over the white base coat, which may enhance the contrast and/or resolution of the decorative pattern 332. In a further alternative, a bonding enhancement layer (not shown), similar to that described above, may be applied to the exposed surface of the base layer 312 before printing the decorative pattern 332.

At step 370, the abrasive sheet 324 may be laminated or otherwise attached to one or more sides of the base layer 312, creating tool 310 sheet. The resulting assembly may be an individual tool. Alternatively, the assembly may include a plurality of tools, which may be separated, e.g., using similar procedures to those described elsewhere herein.

While the invention is susceptible to various modifications, and alternative forms, specific examples thereof have been shown in the drawings and are herein described in detail. It should be understood, however, that the invention is not to be limited to the particular forms or methods disclosed, but, to the contrary, the invention is to cover all modifications, equivalents and alternatives falling within the scope of the appended claims.

I claim:

1. A method for manufacturing an abrasive article having a decorative pattern, comprising:

providing a base layer comprising a first foam sheet having an upper surface;

printing one or more inks or dyes onto the upper surface of the first foam sheet to create a decorative pattern thereon; and bonding abrasive material over the decorative pattern, the abrasive material being translucent or substantially transparent such that the decorative pattern is visible through the abrasive material.

2. The method of claim 1, wherein the one or more inks or dyes are printed by simultaneously printing multiple colors onto the upper surface of the first foam sheet.

3. The method of claim 1, wherein the one or more inks or dyes are printed by successively printing multiple colors onto the upper surface of the first foam sheet.

4. The method of claim 1, wherein the base layer comprises a core layer and wherein a lower surface of the first foam sheet is attached to the core layer.

5. The method of claim 4, further comprising:

attaching a second foam sheet to the core layer opposite the first foam sheet;

printing one or more inks or dyes onto the second foam sheet to create a decorative pattern thereon; and bonding abrasive material over the decorative pattern on the second foam sheet, the abrasive material being translucent or substantially transparent such that the decorative pattern is visible through the abrasive material.

* * * * *